United States Patent [19]

Monreal

[11] Patent Number: 4,678,444

[45] Date of Patent: Jul. 7, 1987

[54] WATER GLIDING SCOOTER BOARD

[76] Inventor: F. Javier Monreal, 4242 Barker Mill Rd., Jamesville, N.Y. 13078

[21] Appl. No.: 832,389

[22] Filed: Feb. 24, 1986

Related U.S. Application Data

[63] Continuation-in-part of Ser. No. 672,813, Nov. 19, 1984, Pat. No. 4,629,434, and a continuation-in-part of Ser. No. 822,627, Jan. 27, 1986.

[51] Int. Cl.[4] ..... A63C 15/00

[52] U.S. Cl. ..... 441/65; 114/363

[58] Field of Search ..... 441/79, 65, 72, 129; 114/346, 357, 361, 363, 364, 253; 280/8, 12 R, 18

[56] References Cited

U.S. PATENT DOCUMENTS

| | | | |
|---|---|---|---|
| 3,340,554 | 9/1967 | Allender | 441/65 |
| 3,777,325 | 12/1973 | Bristol | 441/65 |
| 4,302,860 | 12/1981 | Puch | 441/65 |
| 4,395,241 | 7/1983 | Comparetto | 441/65 |

FOREIGN PATENT DOCUMENTS

| | | | |
|---|---|---|---|
| 1949858 | 4/1971 | Fed. Rep. of Germany | 441/79 |
| 2134621 | 1/1973 | Fed. Rep. of Germany | 440/101 |

*Primary Examiner*—Joseph F. Peters, Jr.
*Assistant Examiner*—Thomas J. Brahan

[57] ABSTRACT

This sporting device is intended to accomodate a rider gliding over water while towed from a speed boat by a tow-rope. It has an oval shape so it can travel in any of two opposite directions. On the upper surface of its floating hull that is roughly flat, it has, towards one end, a hard plastic hood, enclosed and tapered towards the end of the board over which it is placed and open towards the opposite end of the board. Feet securing straps, knee rests and buttocks rest, plus tow-rope engaging protrusions/hooks are provided. This water gliding scooter board can accomodate the rider in a low kneeling, high kneeling, standing and high sitting positions with the tow rope directly engaged by the board or held by the rider.

6 Claims, 4 Drawing Figures

WATER GLIDING SCOOTER BOARD

BACKGROUND AND PURPOSE

This is a continuation-in-part of the earlier application filed under the Ser. No. 06/672,813 filed Nov. 19, 1984 for a Water Gliding Broad U.S. Pat. No. 4,629,434. This is also a continuation-in-part of an earlier application for a Mushroom Shaped Water Glider application Ser. No. 822627, filed Jan. 27, 1986.

Water gliding atop a floating device with the rider being pulled from a speed boat by a tow rope is generally practiced on a pair of long and narrow, identical boards known as skis. A single water ski accomodating both feet of the rider is also used and known as "Slalom Ski". Wider and shorter boards known as "Trick Boards" are also used to accomodate the rider in the standing position. Relatively newer devices consist of wider and thicker boards meant to accomodate the rider in the kneeling position, with his/her thighs strapped to the board thus known as "Knee Board".

The disadvantage of existing knee boards is their relative discomfort in a long ride since the passenger has to keep his/her knees deeply bent with the strap holding tightly around the thighs, thus cutting off the circulation to the lower legs which after a 10 minute ride tend to ache spoiling the sporting fun. "Mounting" the knee board also is somewhat difficult as the rider first begins the ride laying prone on the board and slowly, while holding with one hand to the pulling tow rope, has to get up on his/her knees and cross over the strap using just one hand.

In contrast to existing knee boards, the device of this invention, as that of the earlier application of this inventor for a Water Gliding Board, tries to improve the comfort of the ride by eliminating the necessity of a tight deep knee bent position, eliminating the constricting strap and improving the board versatility by allowing not only a low kneeling (or tight deep knee bent position), but also a high kneeling position and a high sitting position traveling in the opposite direction to the one used when kneeling. This Water Gliding Scooter Board represents a further improvement over the earlier filed Water Gliding Board by substituting a full scooter "hood" for the elevated seat-on-a-stem. The hollow hood is so shaped that it provides a natural "bay" for the rider's knees in a low kneeling position and recessed areas at its top to accomodate the rider's knees in a high kneeling position traveling in one direction and to accomodate the rider's buttocks in a high sitting position when traveling in the opposite direction. Basically the functional idea is the same as that in the Water Gliding Board, but its practical construction has an improved cosmetic appearance, is quite aerodynamic and with its lack of sharp edges is safer to avoid injury in a plunge.

Revision of prior art reveals the two earlier applications of this inventor, already mentioned, and of which this is a continuation-in-part. Taylor's Multipurpose Slide (U.S. Pat. No. 4,028,761) sets the pattern for existing knee boards with the limitations and fun restrictions they represent. Drennen's Water Sport Device (U.S. Pat. No. 3,435,471) consists of a rectangular board to accomodate a kneeling rider. Worth mentioning here is also my earlier application for a Water and Snow Wishbone Shaped Sled application Ser. No. 806,423 filed Dec. 9, 1985 that consists of a bi-forked board to accomodate one or two riders in the different positions mentioned, avoiding any strapping.

SUMMARY OF THE INVENTION

This sporting device consists of a roughly oval, floating board intended to accomodate a rider in water gliding and pulled from a speed boat by a tow rope, and capable of traveling in two opposite directions. The roughly flat board has in its upper surface and towards one of its ends a hard plastic hood, closed and tapered towards the tapered end of the board over which it is placed, and open towards the opposite distant end of the board. The wide opening of the scooter board hood permits the rider's knees/thighs to lock in place without any strapping in a low kneeling position. The upper surface contour of the hood has soft and shallow indentations to accomodate the rider's knees in a high kneeling position (when traveling in the direction of the end of the board where the hood is), and to accomodate the rider's buttocks in a high sitting position when traveling in the opposite direction. The closed, tapered end of the hood, and the opposite end of the scooter board have a soft, upward curved protrusions to accomodate, as hook or connector, the pulling tow rope when the rider does not hold on to it with his/her hands. Soft foot straps are provided for the feet.

DETAILED DESCRIPTION OF THE INVENTION

Figure 1:
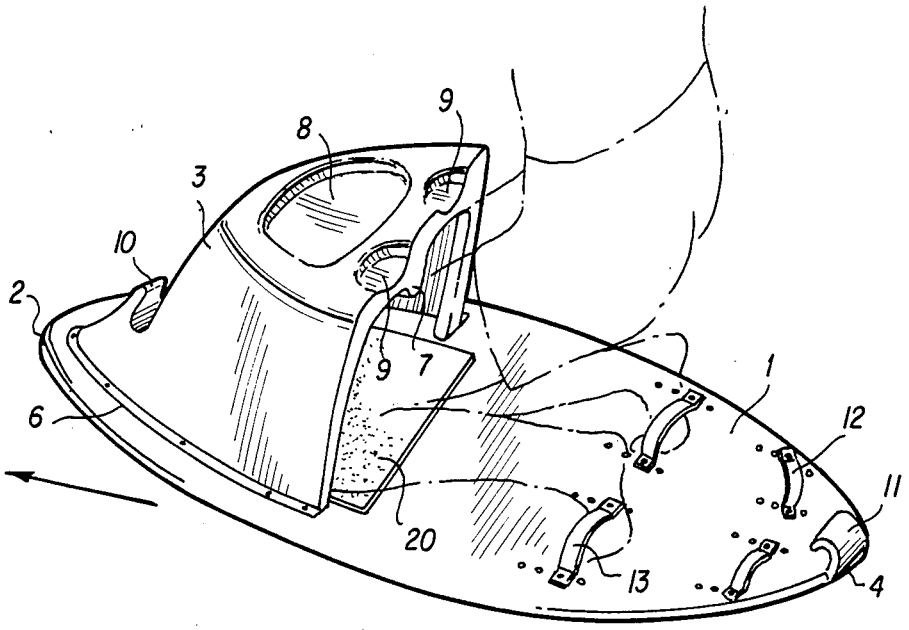
FIG. 1: Is a perspective left lateral view of the instant invention with the rider (in dashed lines) traveling in a low kneeling position in a first direction considering the front of the board the end where the hood is.

In the preferred embodiment, this invention consists of an oval board 1 that has an approximatly flat top surface and a bottom, also roughly flat undersurface, approximately 2" thickness from top surface to undersurface, a widest central area (15" to 24" wide) and rounded, tapered opposite ends capable of accomodating a rider in gliding over water while pulled from a speed boat by a tow rope. One of the tapered ends of the board, herein called front end 2 has a large plastic hood of roughly truncated pyramidal shape 3 sitting on the top surface of the board. This plastic truncated pyramid hood is hollow and open in the part of the pyramid that faces the opposite end 4 of the board (herein called rear end of the board). The wide opening of the hood is identified in FIG. 2 by the numeral 5.

The hood 3 is attached to the flat board 1 by an outturned attchment lip 6 that is glued and/or screwed to the board. The wide rear opening 5 of the hood 3 is wide enough to accomodate within its margins the width of the two thighs of a rider of average build. If different sizes would be manufactured, the width of the opening 5 would vary proportionately to the size of the intended user. The upper lip of the opening 5 is provided with a down pointing protrusion 7, to better fit and hold each thigh.

The rounded and smooth top of the truncated pyramid hood has three indentations: A large, rounded, shallow, dish-like identation or depression 8 that serves as a rest area for the rider's buttocks and two smaller indentations or depressions 9 and 9 that are right over the opening 5 of the hood to accomodate each of the rider's knees when the rider travels in a high kneeling position.

The rounded and smooth hood 3 has also, near its front end and opposite its rear opening 5, a deep indentation 10 where the tow rope can be engaged to begin the ride or whenever the rider is not holding the tow rope with his/her own hands and is traveling in a first direction (that is to say, with the end 2 of the board pointing in the direction of traveling). The board itself 1 has an upward protrusion (of smooth edges) identified by the numeral 11, in the rear end 4, protrusion that as the indentation 10, also serves to engage the tow rope but in the case of protrusion 11, when the rider is sitting over the hood traveling in the direction of end 4.

The flat board 1 has two sets (i.e. pairs) of straps to receive, respectively, the feet of the rider when the rider travels in a high sitting position, pair marked with the number 12, and the feet of the rider when the rider travels in a high kneeling position facing the opposite way, pair of straps marked with the numeral 13. Though the feet of the rider can also engage the strap pair 13 when traveling in a low kneeling position as per FIG. 1, this engagement is not necessary in this position since the rider is sufficiently "hooked" to the scooter board by simply placing his/her knees/thighs through the opening of the hood.

The flat board 1 can be constructed of blow-molded plastic having its core hollow or foam filled.

The hood can be constructed separately of plastic sheeting, vacuum or injection molded into shape and then glued and/or scrwed to the front end of the flat board 1.

Figure 3:
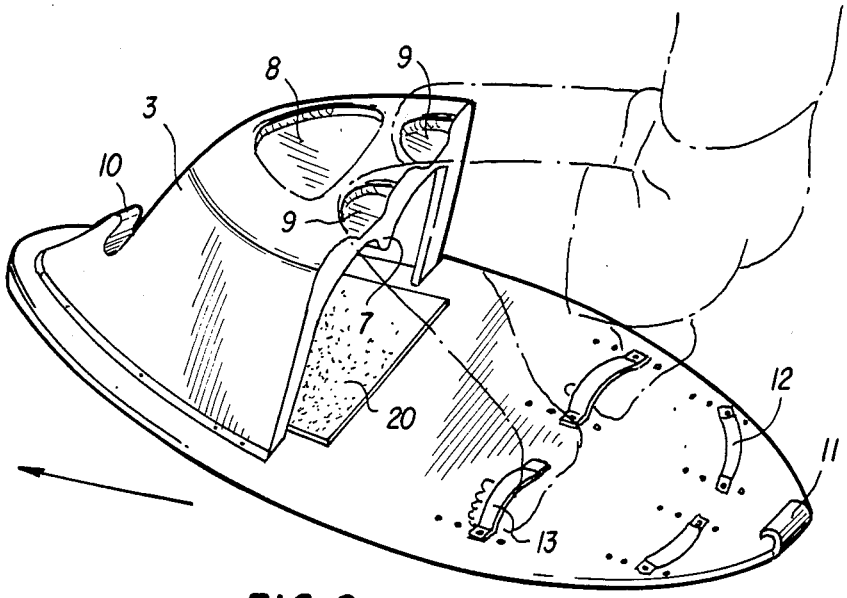
FIG. 3: Is a perspective left lateral view of the same instant invention with the rider (in dashed lines) traveling in a high kneeling position in the first direction.
Figure 4A:
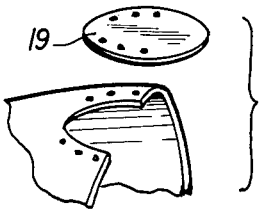
FIG. 4: Is a perspective lateral view of a simpler construction.
Figure 4:
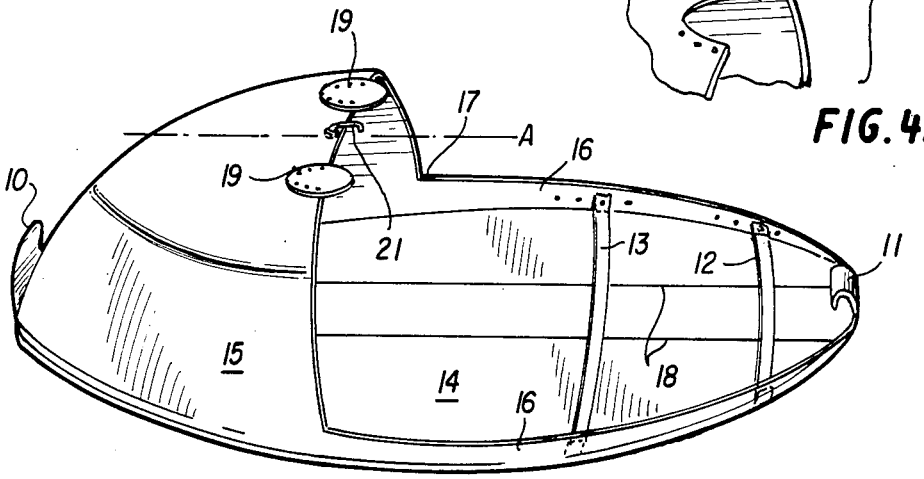
Figure 4B:
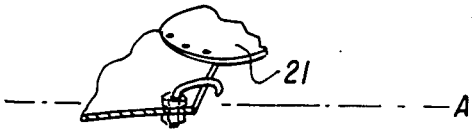

As per FIG. 4, a simpler version of the scooter board can be constructed keeping the approximate shape of the scooter board described hereunto. In this case, the board 14 is made one piece with its hood 15 that thus requires no attachment lip. This simpler design can be built much cheaper and lighter than the model described and depicted in FIGS. 1 through 3, for instance consisting of one piece plastic sheeting, vacuum or injection molded into shape. The attachment protrusion 10, hook 11 and straps 12 and 13 are not changed. The opening 16 of the hood 15 is comparatively larger to allow stacking of one scooter board into another for cheaper packaging.

The outer rim of the simplified scooter board verasion can be left flash with the surface of the board as in board 1, or it may have, all around, an up-turned lip 16 tapered down from a highst point 17 where it forms the hood 15, to the opposite end of the board where it forms the tow-rope connecting hook 11.

Figure 2:
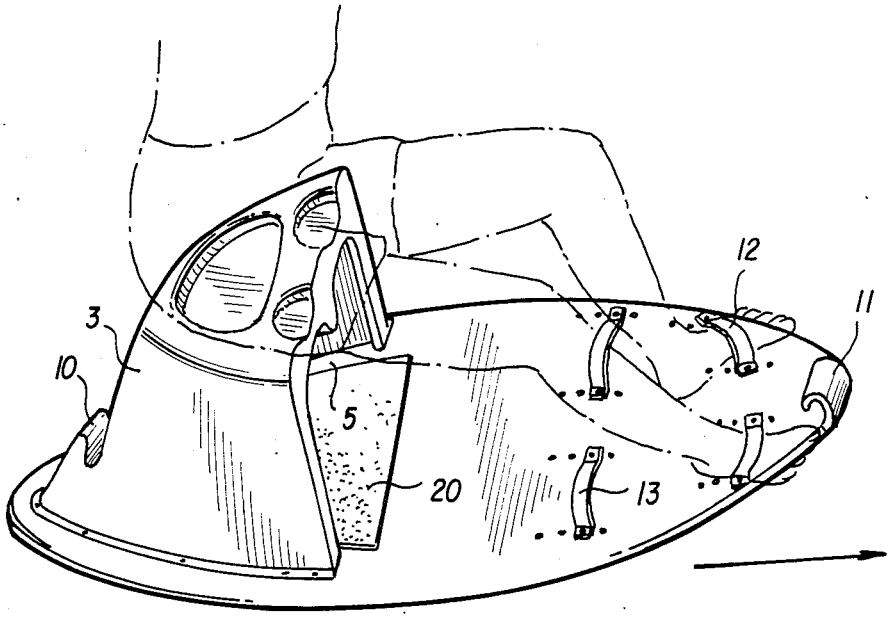
FIG. 2: Is a perspective left lateral view of the same instant invention with the rider (in dashed lines) traveling in a high sitting position in a second direction opposite to the first direction.

The under surface of the board can be provided with parallel soft ribs or depressions, as ride stabilizers, not shown in FIGS. 1 through 3 but seen in FIG. 4 due to the single plastic sheeting construction that allows to see them on the top surface and are identified with the numeral 18.

The soft knee pockets 9 and 9 of FIGS. 1 through 3 are simply a depression or indentation in the hull of the hood 3, are, in the simpler version of FIG. 4, two, "C" shape cut out areas 19 and 19. The cut out areas 19 and 19 have, in turn, all around their rim a glued and/or rivetted elastic rubber patch that thus can stretch down to receive the rider's knees when he/she travel in a high kneeling position. This arrangement of the knee-receiving areas 19 and 19, flush with the top surface and contour of the hood 15 when not in use, allows full stacking of one scooter board into another for packaging and lesser shiping costs, as intended by the very idea of this simpler version of water gliding scooter board.

Variable padding (i.e. a glued on rubber mat 20) is provided, that only needs to be present, as depicted in the drawings, in the upper surface of the board under the hood, intended for a knee rest when the rider travels in a low kneeling position. Either thin padding or a high friction/sticky coating can also be applied to the high seat rest 8 and to the two upper knee rests 9 and 9 to help the rider stay in position.

The feet-holding straps 12 and 13 can also consist, as depicted in the simplified scooter board of FIG. 4, of a single strap each, reaching from side of the board to side of the board, instead of simply holding just one foot each if they are separate pairs as depicted in FIGS. 1 through 3. This way, as drawn in FIG. 4, each elastic strap is longer, and the rider can pass both feet under it in a more readily manner.

FIGS. 1 through 3 also show the opening of the hood with a down-pointing protrusion at its top-center, protrusion 7 that can serve to engage the loop of the tow-rope when traveling in either direction. Such protrusion thus makes unnecessary the presence of the engaging hooks 10 and 11. In the simplified board of FIG. 4, however, such protrusion, if present, would interfere with the stacking of one board-hood over another, as it would prevent the hump of a hood to fit inside the hood of the next board. Thus, for the simplified model of FIG. 4 a freely pivoting hook 21 has been provided in the same position of the protrusion 7 and instead of it, to engage the tow-rope.

What I now claim is:

1. A sporting device, herein called water gliding scooter board, capable of accomodating a water gliding rider in the positions of low kneeling, high kneeling and high sitting, and of traveling in two opposite directions, comprising:

a floating oval board constructed of a seamless, foam-filled plastic sheeting unitarian body measuring 4' to 5' in approximate length, 15" to 24" in approximate width at its widest middle section and 1" to 3" in thickness and having rounded contours, a hard plastic hood mounted and screwed in place at one end of said oval board, said hood approximately shaped as a truncated irregular pyramid, enclosed and tapered to a point towards the end of the said board upon which it is mounted, and fully open in the direction facing the opposite end of said board; said plastic hood having a top surface elevated 10" to 14" above the upper surface of said board, said top surface of said hood having at the edge that faces the other end of the said board a pair of smoothly recessed indentations capable of accomodating the rider's knees when in a high kneeling position and traveling in a first direction; said plastic hood at its said top surface having a shallow and smoothly recessed dish-like indentation capable of accomodating the rider's buttocks when in a high sitting position facing the other end of said board and traveling in a second direction opposite the said first direction, a first foot receiving means in the form of elestic strap(s) capable of accomodating the rider's feet when in a high kneeling position traveling in the said first direction, a second foot receiving means in the form of elastic strap(s) capable of accomodating the rider's feet in a high sitting position traveling in the said second direction, a first two-rope engaging means in the form of a smooth, hook-shaped protrusion placed at the said tapered enclosed end of the said hood, capable of receiving the pulling tow-rope when traveling in the said first direction a second two-rope engaging means in the form of a smooth, hook-shaped protrusion placed at the very tip of the said other end of said board, capable of receiving the pulling tow-rope when traveling the said second direction.

2. A water gliding scooter board according to claim #1 wherein the first foot receiving means comprises a pair of soft, elastic, rubberized straps attached the upper surface of the board at repositionable points.

3. A water gliding scooter board according to claim #1 wherein the second foot reciving means comprises a pair of soft, elastic, rubberized straps attached to the upper surface of the board at repositionable points.

4. A water gliding scooter board according to claim #1 wherein the first tow-rope engaging means comprises a simple rigid hook screwed at the tapered, enclosed end of the hood.

5. A water gliding scooter board according to claim #1 wherein the second tow-rope engaging means comprises a simple rigid hook screwed at the tip of the other end of the board.

6. A water gliding scooter board according to claim #1 wherein the upper free edge of the hood opening has a down-pointing protrusion at its very center, protrusion that is capable of engaging the tow-rope when the said board travels with its rider in any said position and any of the two said opposite directions.

* * * * *